US005575013A

United States Patent [19]

Kräck

[11] Patent Number: 5,575,013

[45] Date of Patent: Nov. 19, 1996

[54] EASY ON SOCK

[76] Inventor: Frank G. Kräck, 8035 Woodgate Ct., Indianapolis, Ind. 46168

[21] Appl. No.: 322,317

[22] Filed: Oct. 13, 1994

Related U.S. Application Data

[63] Continuation-in-part of Ser. No. 66,511, May 24, 1993, abandoned, which is a continuation-in-part of Ser. No. 897,914, Jun. 12, 1992, abandoned, which is a continuation-in-part of Ser. No. 760,523, Sep. 16, 1991, abandoned.

[51] Int. Cl.[6] ..... A41B 11/00

[52] U.S. Cl. ..... 2/239; 2/912

[58] Field of Search ..... 2/239, 240, 22, 2/911, 912; 36/9 R, 10, 8.1, 8.4, 7.1 R; 602/62, 65, 66, 63

[56] References Cited

U.S. PATENT DOCUMENTS

| | | | |
|---|---|---|---|
| D. 080,129 | 12/1929 | LeVeque | 2/239 |
| 343,460 | 6/1886 | Kimball | 36/9 R |
| 1,523,133 | 1/1925 | McIntyre | 36/9 R |
| 2,022,444 | 11/1935 | Van Voorhis | 2/240 |
| 2,041,505 | 5/1936 | Woerle | 36/8.1 |
| 2,144,563 | 1/1939 | Davis | 66/185 |
| 2,193,056 | 3/1940 | Burn | 2/239 |
| 2,598,217 | 5/1952 | Bronson | 36/9 R |
| 2,603,889 | 7/1952 | Lahnstein et al. | 36/9 R |
| 2,642,678 | 6/1953 | Fula | 36/9 R |
| 2,703,405 | 3/1955 | Smallberg, Sr. | 2/239 |
| 2,919,503 | 1/1960 | Sholovitz | 36/9 R |
| 3,106,790 | 10/1963 | Zimmon | 2/919 |
| 4,104,892 | 8/1978 | Thorneburg | 2/239 |

FOREIGN PATENT DOCUMENTS 0284361 9/1988 European Pat. Off. .

*Primary Examiner*—Amy B. Vanatta
*Attorney, Agent, or Firm*—Woodard, Emhardt, Naughton Moriarty & McNett

[57] ABSTRACT

An easy-on sock having a split opening extending down the middle of the top surface of the sock from the lower leg portion to the toe pocket of the sock is provided. An extension flap, used to close the split, is connected along one edge of the split and extends substantially the full length of the split. Hook and loop closure strips are attached on the free edge of the extension strip and along the other edge of the split to enable the extension flap to be folded over the split and secured to the opposing hook and loop closure strip. In one embodiment, an insert flap is additionally connected to the other edge of the split, opposite the extension flap. A hook and loop type connector is attached to the outer surface of the insert flap and a mating hook and loop type sizing strip is attached to a corresponding location on the inner surface of the extension flap. Thus, the sock may be closely fitted to the foot of the user by first mating the hook and loop type closure strips and/or connectors. In all embodiments there is provided a sock having the ability to cover the split and the person's foot as in a conventional sock, but without the pulling, squeezing and rubbing associated with conventional socks.

22 Claims, 12 Drawing Sheets

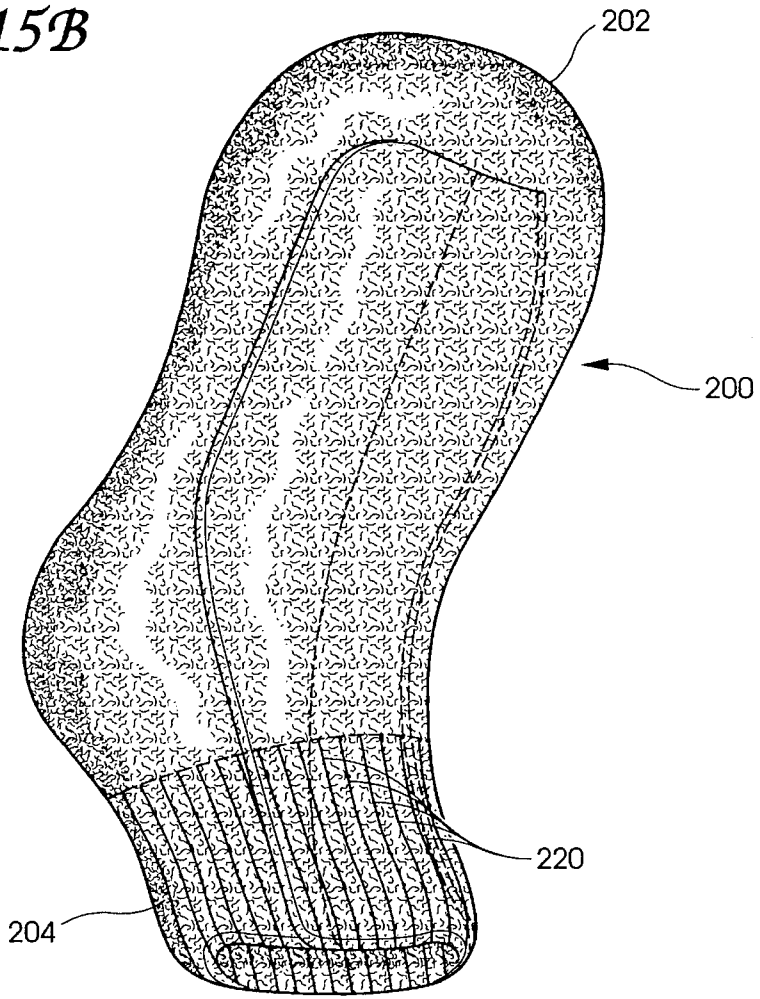
Fig. 16
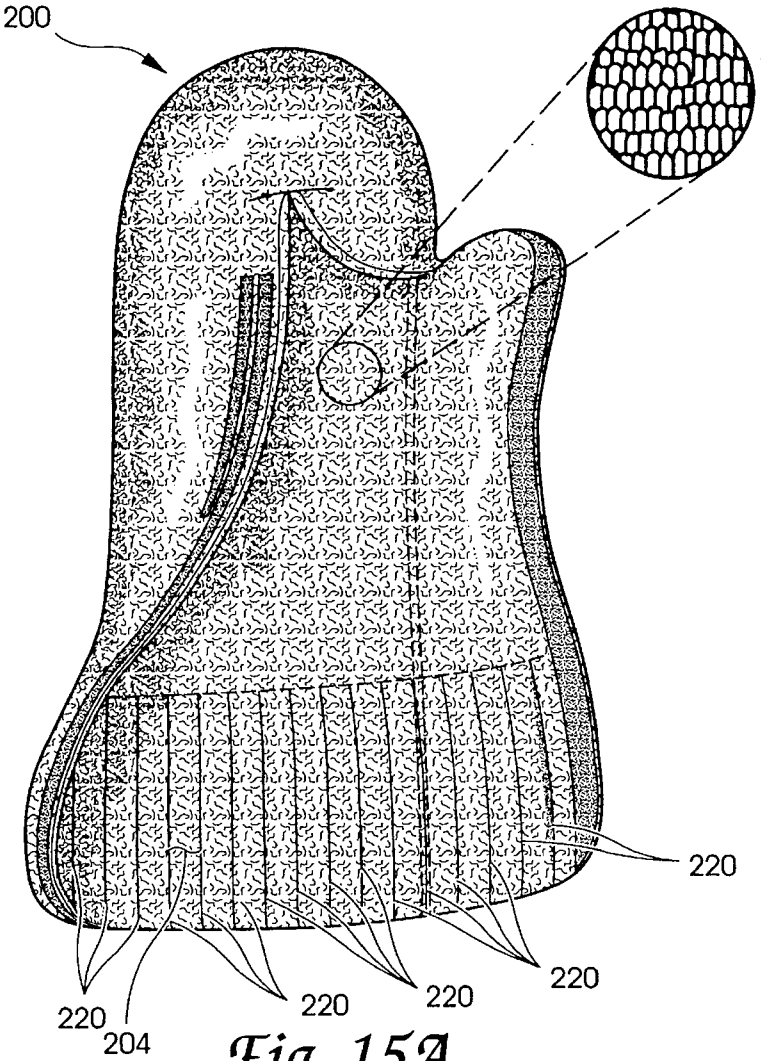
Fig. 15B
Fig. 15A

EASY ON SOCK

REFERENCE TO RELATED APPLICATION

This application is a continuation-in-part of U.S. patent application Ser. No. 08/066,511, filed May 24, 1993, now abandoned, which is a continuation-in-part of U.S. patent application Ser. No. 07/897,914, filed Jun. 12, 1992, now abandoned, which is a continuation-in-part of U.S. patent application Ser. No. 07/760,523, filed Sep. 16, 1991, which is now abandoned.

BACKGROUND OF THE INVENTION

This invention relates generally to socks, and in particular, to socks which have the ability to be placed on a foot in an atraumatic wrapping motion rather than the potentially painful pulling, squeezing and rubbing associated with conventional socks.

Oftentimes people with foot problems, be it due to injuries, recent surgery or some other complication, have difficulty in wearing conventional socks while their foot is healing because of the pain involved in pulling a conventional sock over the injured foot. These people are normally faced with the alternative of either leaving their injured foot uncovered while it heals, which leaves the foot exposed to dirt and chills, or they must experience the pain caused by having a sock slid and squeezed over the tender portions of their injured foot. Other persons, including the elderly and those with arthritis or back trouble, simply are unable to pull conventional socks over their feet due to their limited flexibility and general inability to bend over far enough to do so.

What is needed is a sock that has the ability to completely cover a foot as in a conventional sock but which may be wrapped onto the foot instead of the normal pulling, stitching and sliding that accompanies the placement of a conventional sock on a foot, thus eliminating unnecessary pain for those who have foot injuries and also enabling those persons with limited flexibility to more easily place socks on their feet.

SUMMARY OF THE INVENTION

The easy-on sock of the present invention is like an ordinary sock in that it includes a toe pocket, a sole portion, a heal portion, a lower leg portion and an upper portion extending between the toe portion and the lower leg potion. However, unlike a conventional sock, the easy-on sock has a split extending from the toe pocket through the upper portion and the lower leg portion of the sock. The split defines first and second opposing edges that terminate at the toe pocket. An extension flap is sewn on or otherwise connected to the sock along the first opposing edge of the split. A hook and loop closure means is attached to both the extension flap and along the second opposing edge of the split for releasably securing the edge of the extension flap to the second opposing edge of the sock to cover the foot and close the split.

Another embodiment of the present invention comprises a method of atraumatically placing an easy-on sock on a person's foot.

The first step comprises inserting the person's toes into the toe pocket of an easy-on sock. Next, the remainder of the sock is wrapped around the person's foot and the extension flap is attached along the opposing edge of the split. All of this is accomplished without the pulling, squeezing and rubbing associated with conventional socks.

One object of the present invention is to provide a sock which may be atraumatically placed on the foot of a person having a tender or otherwise injured foot.

Another object of the present invention is to provide a sock which is more easily placed on the foot, especially for those persons who lack flexibility or are otherwise unable to pull conventional socks onto their feet.

Still another object of the present invention is to provide a method of placing a sock on a person's foot in a way that avoids the tugging, sliding and squeezing of a conventional sock.

Related objects and advantages of the present invention will be apparent from the following description.

BRIEF DESCRIPTION OF THE DRAWINGS

FIGS. 15A, 15B and 16 show a further embodiment of the present invention.

DESCRIPTION OF THE PREFERRED EMBODIMENT

Figure 1:
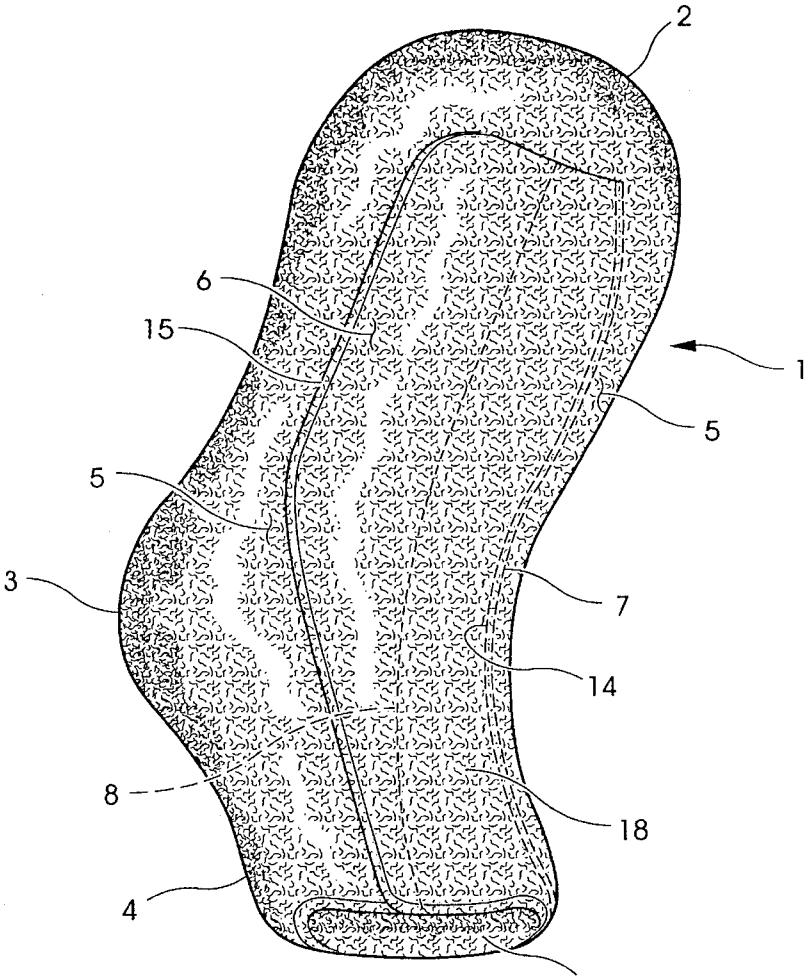
FIG. 1 is an off-center top view of the sock according to a first embodiment of the present invention in its closed position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, FIG. 1 shows an easy-on sock 1 according to the present invention in its closed position. Sock 1 is like any conventional sock in that it includes a toe pocket 2, a heel portion 3, a sole portion (which cannot be seen), a lower leg portion 4 and an upper portion 5. Upper portion 5 generally refers to that portion of the sock which extends between the toe pocket 2 and the lower leg portion 4 on the upper side of the sock. Sock 1 is also like any conventional sock in that it is made form a suitable soft and flexible fabric such as a cotton polyester blend. Likewise, sock 1 of the present invention can come in a variety of different sizes as in a conventional sock. The lower leg portion 4 of sock 1 shown in FIG. 1 is relatively short in this case and extends just above the ankle of the person wearing the sock; however, like conventional socks, the lower leg portion 4 of the sock could easily well be long enough to extend over the calf or even the knee of the person wearing the sock without departing from the spirit of the present invention.

Figure 2:
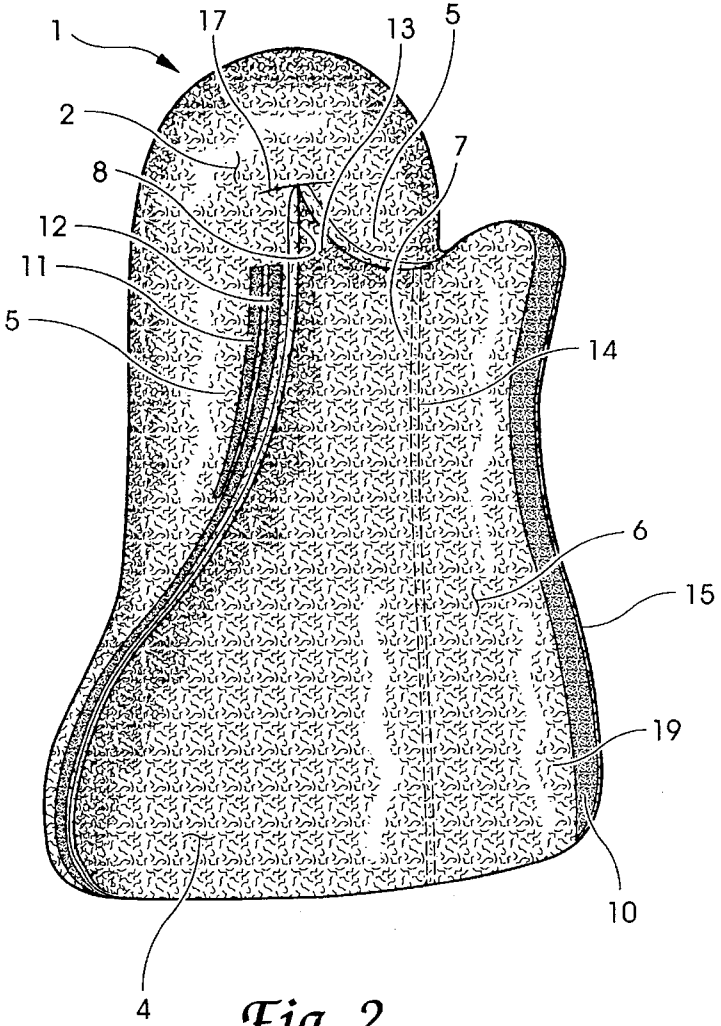
FIG. 2 is a top view of the sock of FIG. 1 in its open position.
Figure 3:
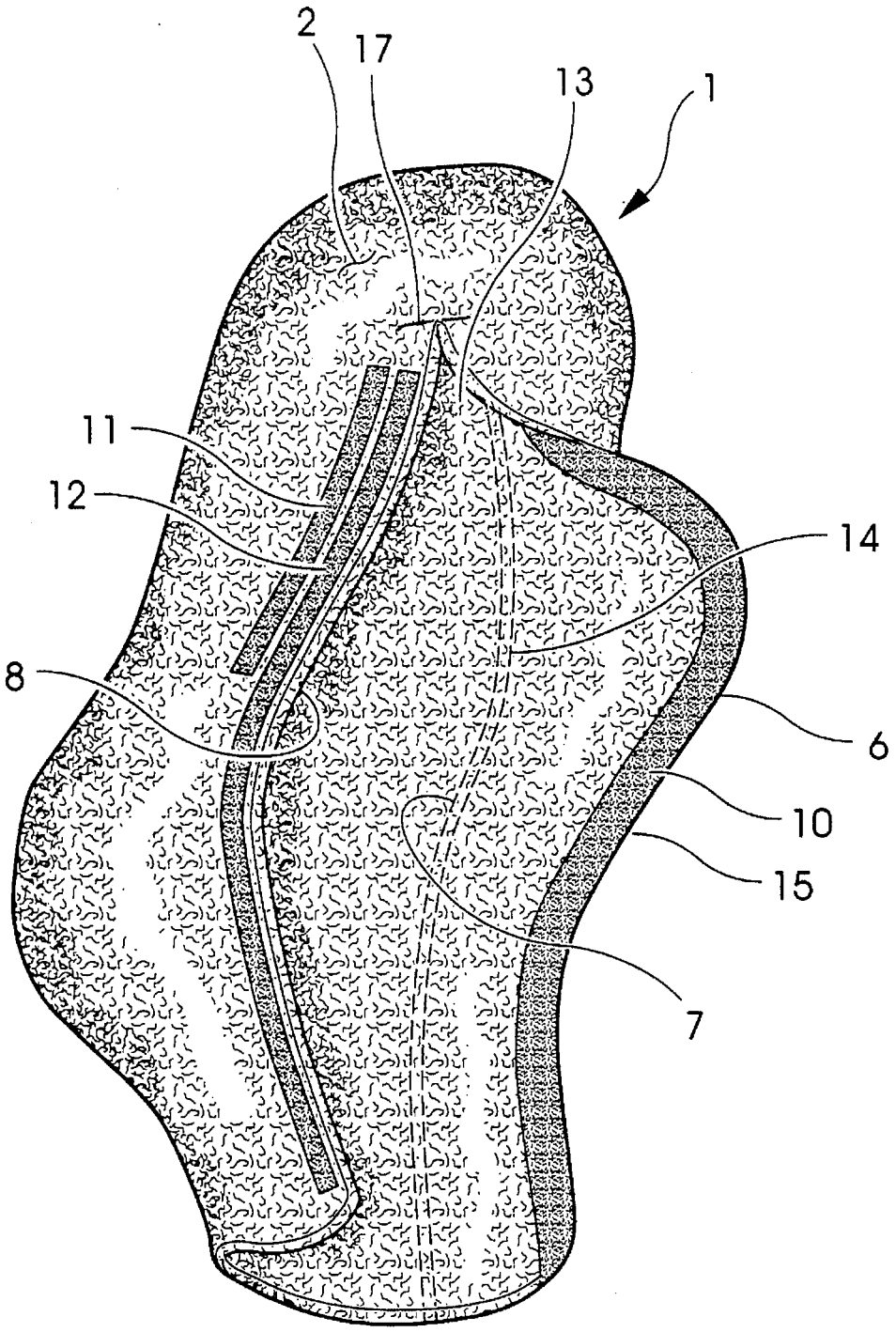
FIG. 3 is an off-center top view of the sock of FIG. 1 with the flap in its open position.

Referring also to FIGS. 2 and 3, sock 1 of the present invention is different from a conventional sock in that it includes a split 13 extending from toe pocket 2 through upper portion 5 and lower leg portion 4. Split 13 preferably bisects upper portion 5 and lower leg portion 4 of the sock, but could equally well be off-center from the line of symmetry of the sock. Also, the split could be slanted or curved across the top portion of the sock in order to accommodate different foot injuries. On either side of split 13 are opposing edges 7 and 8 which extend the length of the split 13. Split 13 is preferably made by simply taking a conventional sock and cutting it along the center line of the lower leg portion and the upper portion of the sock until the cut is adjacent to toe pocket 2 of the sock. A reinforcing stitch 17 can then be made at the point where the split terminates in the toe section 2 in order to prevent the split from extending by unwanted tearing into the toe portion. Thus, the cut that produces split 13 renders the sock completely open except for the relatively small toe pocket defined at the end of the sock.

Easy on sock 1 also includes an extension flap 6, which is preferably made from the same material as the remaining portion of the sock but could equally well be made from a different fabric. Extension flap 6 could also include some elastic which would further enable the resulting sock to be used on a variety of different sized feet (i.e. one size fits all). Extension flap 6 is preferably in the form of an elongated strip having a length substantially equal to the length of the split 13 and a width on the order of two inches or more. Extension flap 6 includes side edge 14 and side edge 15. In making easy-on sock 1, side edge 14 is simply attached along edge 7 of split 13, preferably by sewing or any other acceptable means which are well known in the art. For instance, side edge 14 of extension flap 6 could be attached to edge 7 of split 13 by other means such as a zipper in the event that it is desirable to make extension flap 6 removable from the remaining portion of the sock. Additionally, extension flap 6 may be integrally formed along edge 7.

Like the remainder of the sock 1, extension 6 has an inner surface 19 and an outer surface 18. Attached to inner surface 19 adjacent side edge 15 is a strip of hook and loop closure material 10, which is preferably on the order of one-half one inch wide. Hook and loop closure strips 11 and 12 are attached on the outer surface of the sock along edge 8 of split 13. Of course, it is irrelevant whether the Rook strip is attached to the sock or the extension flap. What is important is that strip 10 be either a hook or a loop strip and that strips 11 and 12 be the other of the hook or loop so that strip 10 can be releasably secured to strips 11 and 12. Relatively short strip 11 is included to give the resulting sock more adjustability. Strips 10, 11, and 12 are preferably sewn to the underlying material but could equally well be attached in some other fashion which is well known in the art, such as by snaps or adhesives.

Figure 5:
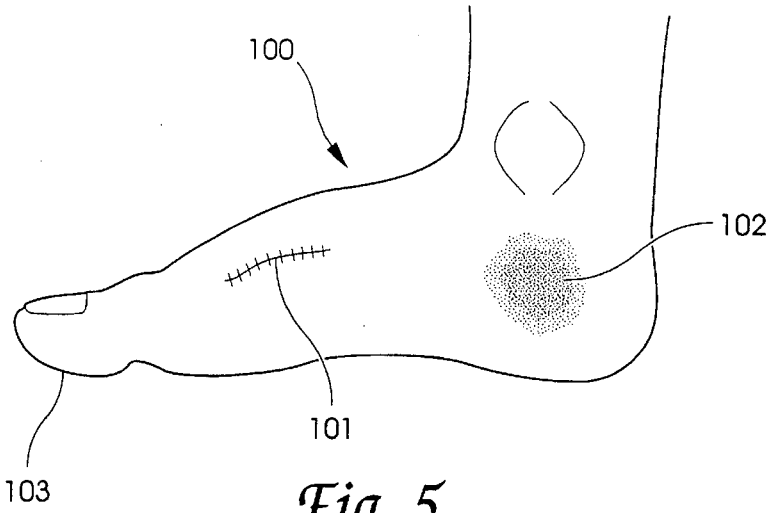
FIG. 5 is a side view of an injured foot.
Figure 6:
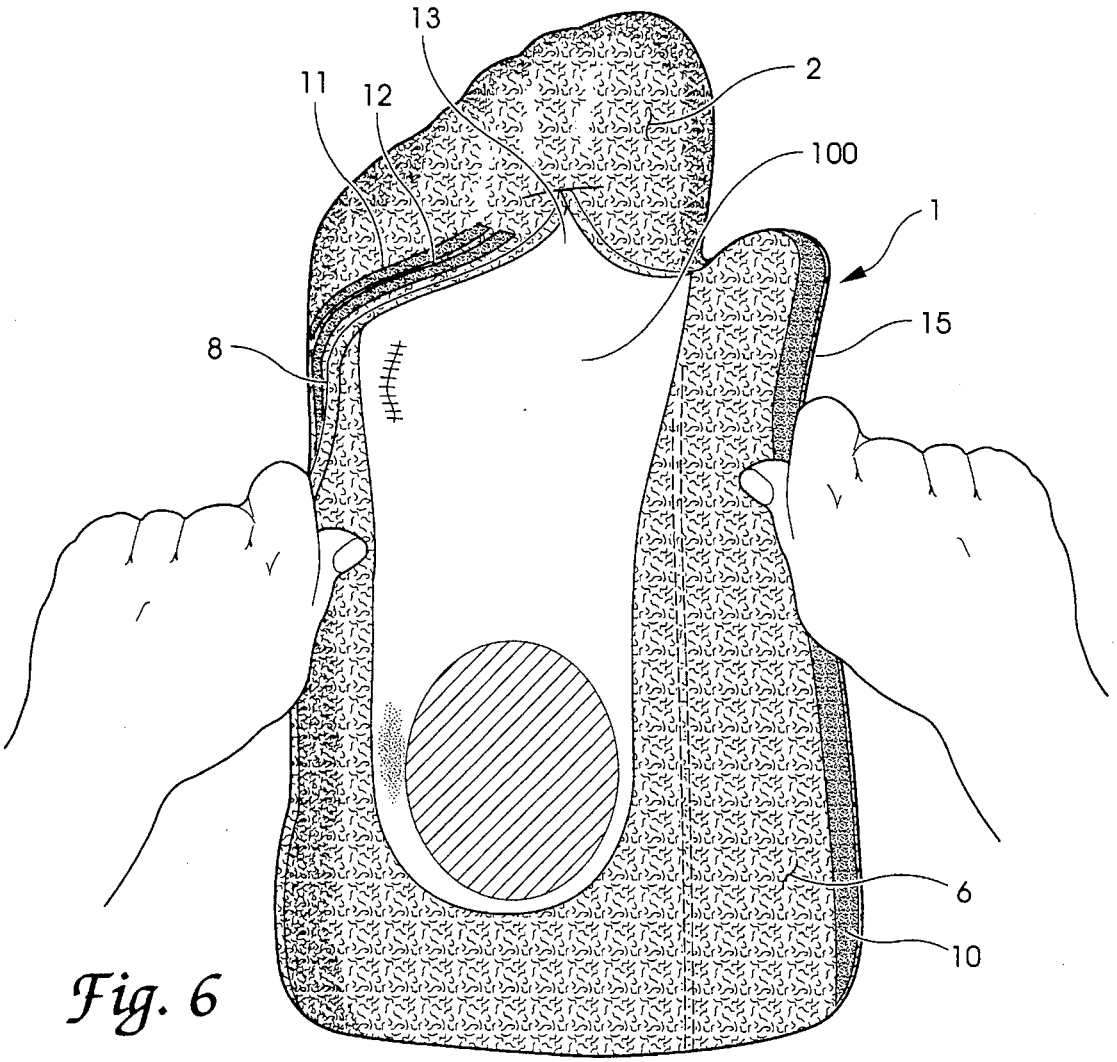
FIG. 6 is a top view of the injured foot of FIG. 5 after an easy-on sock according to the present invention has been partially placed on the person's foot.
Figure 7:
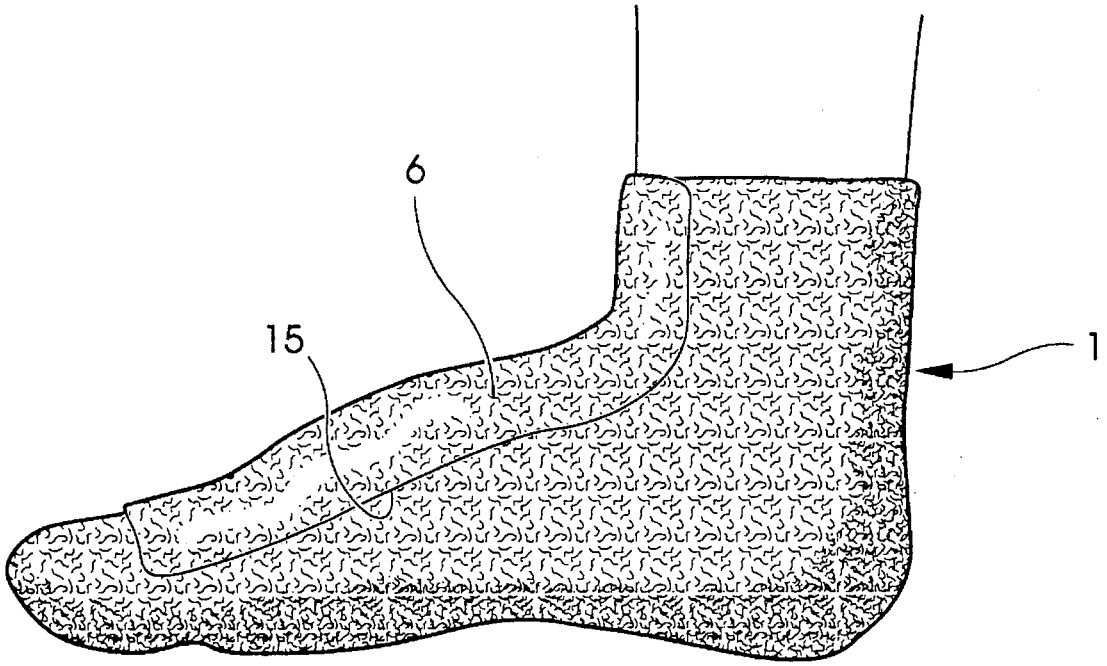
FIG. 7 is a side view of the injured foot of FIGS. 5 and 6 after the easy-on sock has covered the person's foot.

FIGS. 5–7 illustrate how the easy-on sock of the present invention can be put on a person's injured foot 100 in a way that avoids the painful squeezing, pulling and rubbing of conventional socks. In this case, foot 100 is healing from a stitched cut 101 and a bruise 102, both of which would cause pain if a conventional sock was squeezed and slid over the foot. The first step in putting on the sock is accomplished by simply inserting the person's toes 103 into the toe pocket portion 2 with the sock split wide open as shown in FIG. 6. Preferably, this is done without the remainder of the person's foot, particularly the injured portions 101 and 102, having to come into contact with the remainder of the sock. Once the toes are covered, the person moves the sole portion of the sock into contact with the bottom of the person's foot by gripping edge 8 with one hand and side edge 15 of extension strip 6 with the other hand. The sock can then be closed simply by wrapping extension flap 6 over the instep of the person's foot and then contacting strip 10 against strips 11 and 12 in order to secure the sock closed as showing in FIG. 7. Apart from possibly the person's toes, easy-on-sock 1 can cover a foot without the squeezing and/or rubbing that inherently accompanies conventional socks.

Thus, when the sock is on the person's foot, easy-on sock 1 appears similar to a conventional sock with no openings except for the opening through which the person's leg extends. However, because the sock can be opened, the sock can be placed on the foot in an atraumatic wrapping motion rather than the potentially painful pulling and squeezing of a conventional sock. Strip 12 is preferably spaced back from opposing edged 8 on the order of a quarter of an inch or more so that the sock material overlaps when it is closed as in FIGS. 1 and 6 so as to lessen the likelihood that the closure strips will come in contact with the skin of the foot causing unnecessary pain.

The comfort of sock 1 can be easily adjusted simply by placing the extension flap over any part of the closure strips 11 and 12 so that the sock can accommodate swelling and tenderness by eliminating tightness and pain in the injured area of the foot.

Figure 4:
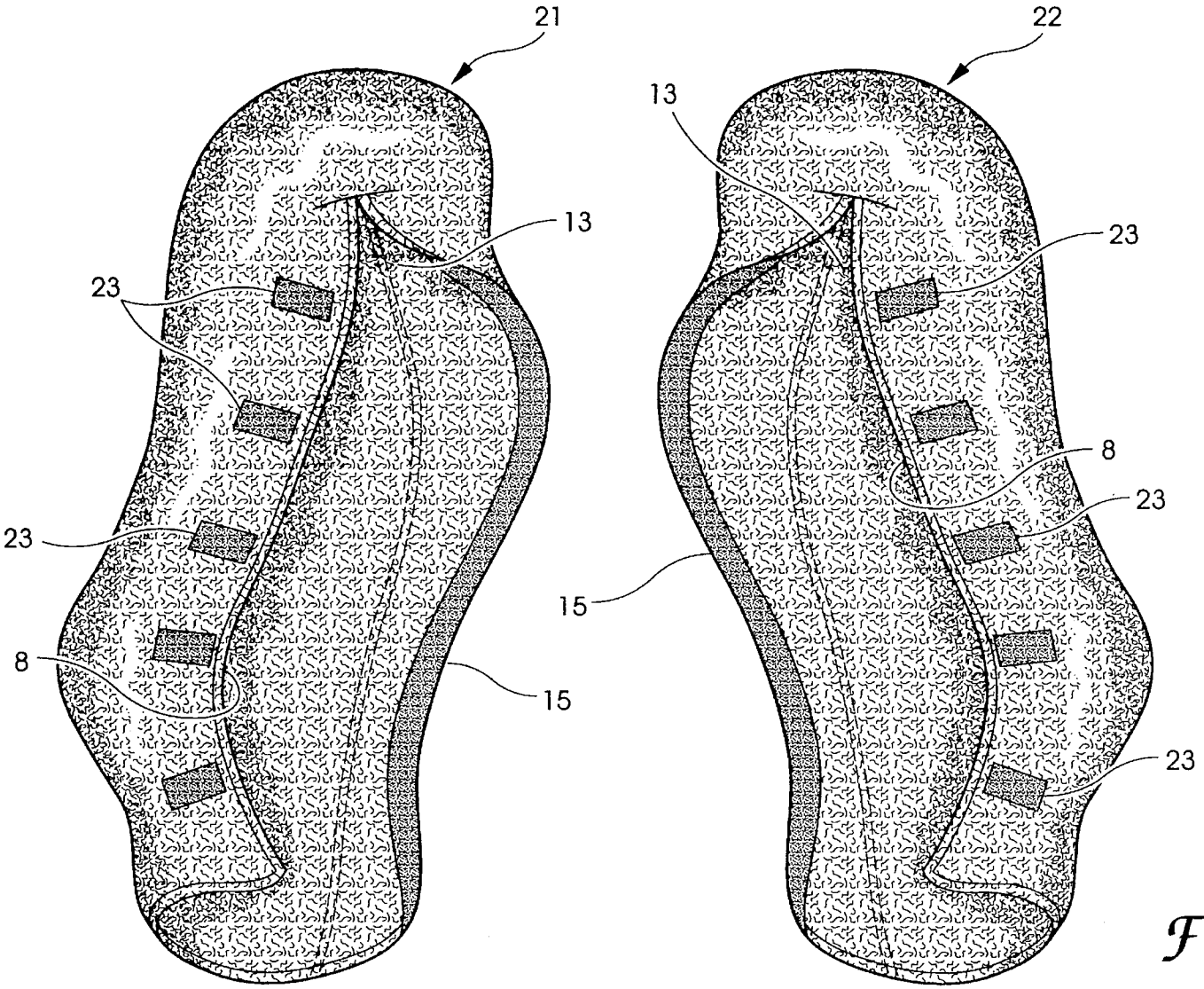
FIG. 4 is a top view of a pair of socks according to another embodiment of the present invention.

FIG. 4 shows a pair of easy-on socks 21 and 22 according to another embodiment of the present invention. Socks 21 and 22 are similar in all respects to sock 1 discussed earlier except in place of closure strips 11 and 12 on sock 1, socks 21 and 22 include a plurality of strip portions 23 which are distributed along the length of edge 8 of split 13. Closure strip portions 23 are preferably on the order of one-half inch wide and are evenly spaced along edge 8 starting adjacent to the toe portion of the sock and distributed all of the way up to the lower leg portion of the sock. The plurality of strip portions 23 enable this embodiment to be adjusted more easily by just repositioning the extension flap along strip portions 23 in a way which is most comfortable to the person wearing the sock. Of course, the importance of being able to adjust the extension flap closure is to eliminate unnecessary pressure and tightness against an injured foot. It should also be noted that socks 21 and 22 are intended for use on the left and right foot, respectively. In any event, having the extension flap of the sock close toward the outside of the foot is generally easier than closing toward the inside of the foot. This is because closing toward the outside of the foot involves a more ergonomically natural motion of the hands and arms.

Figure 8:
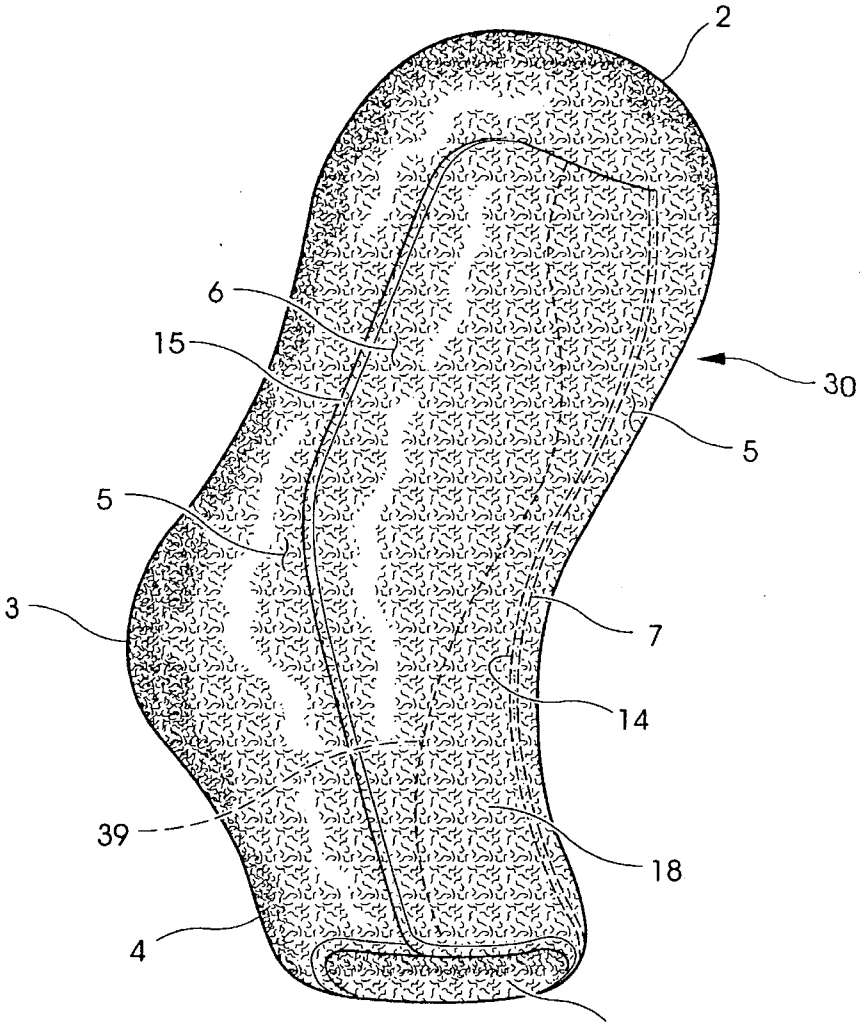
FIG. 8 is an off-center top view of a sock according to a further embodiment of the present invention in its closed position.
Figure 9:
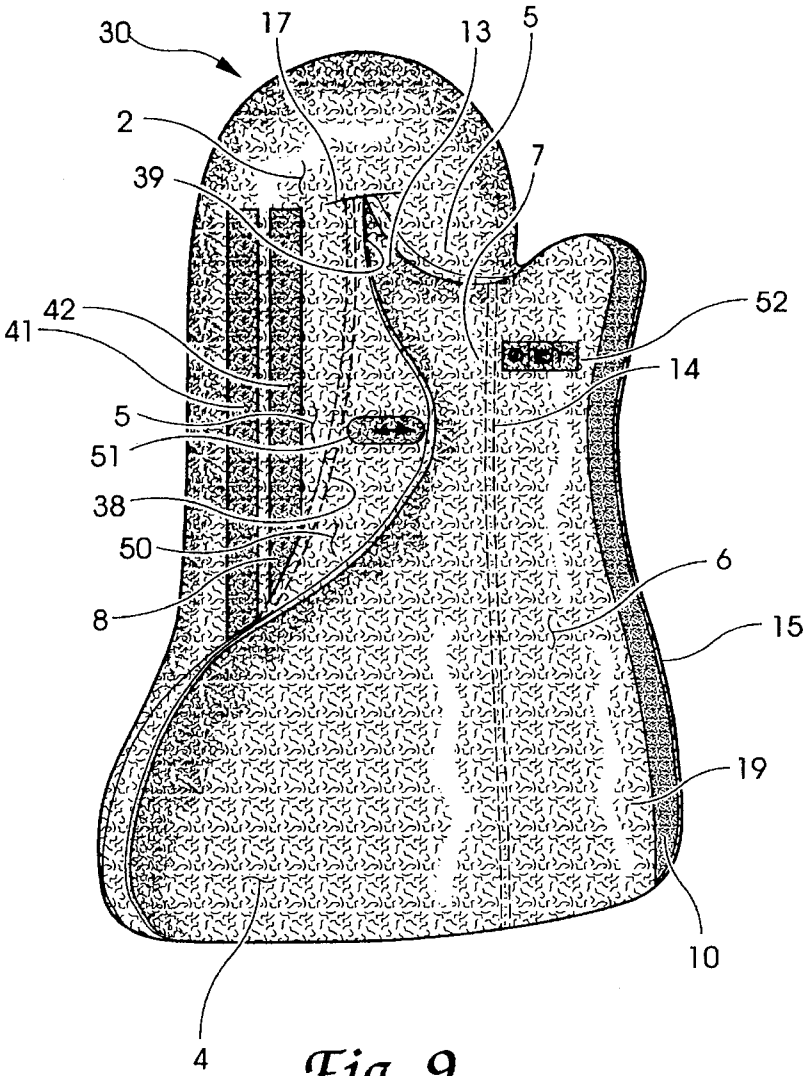
FIG. 9 is a top view of the sock of FIG. 8 in its open position.
Figure 10:
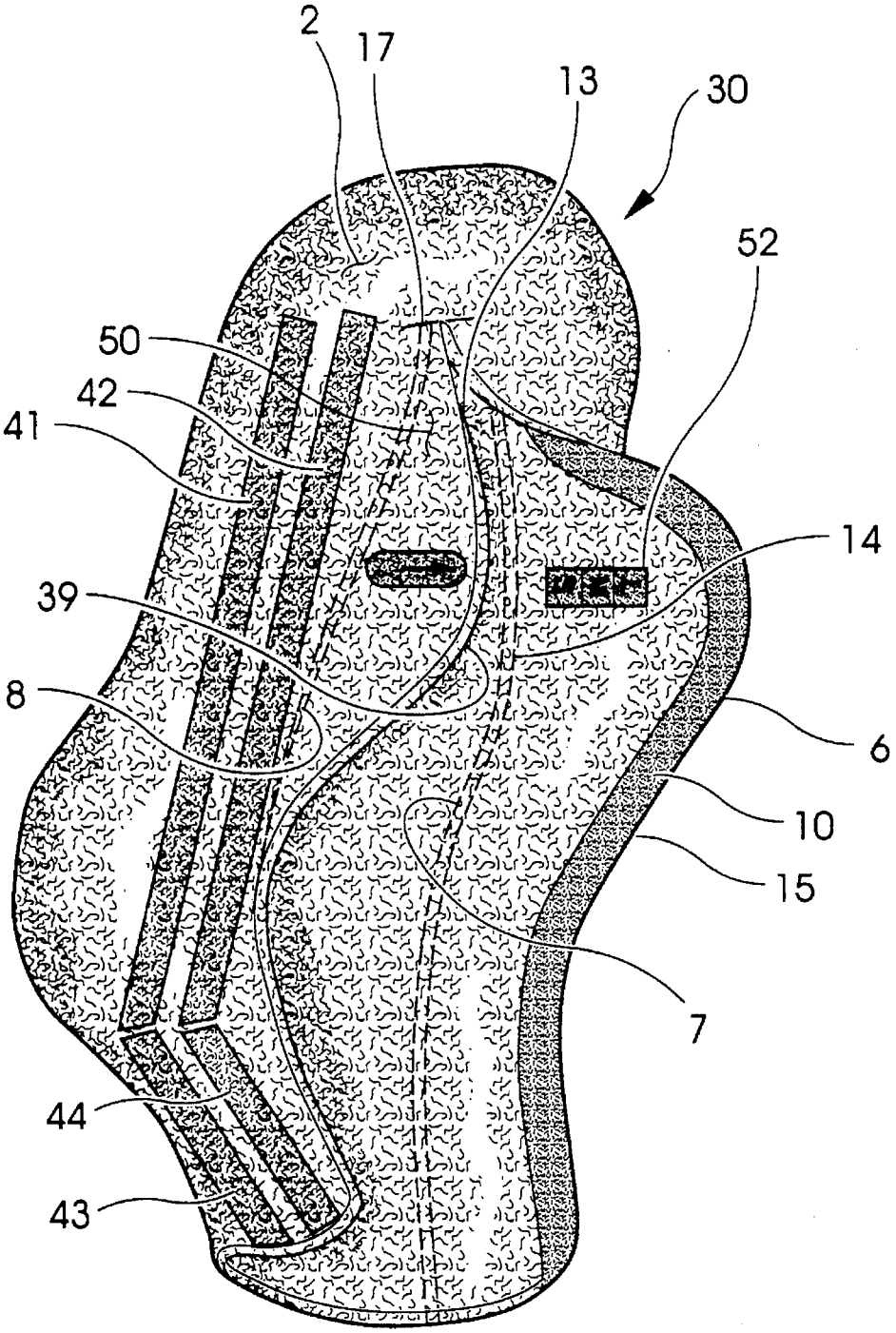
FIG. 10 is an off-center top view of the sock of FIG. 9 with the flap in its open position.

Referring now to FIGS. 8–10, there is shown a further embodiment of the present invention. More particularly, FIG. 8 shows an easy-on sock 30 according to the present embodiment in its closed position. As with sock 1 above, easy-on sock 30 is like a conventional sock in that it includes a toe pocket 2, a heel portion 3, a sole portion (which cannot be seen), a lower leg portion 4 and an upper portion 5. Likewise, sock 30 is also like any conventional sock in that it is made from a suitable soft and flexible fabric such as a cotton polyester blend. Sock 30 of the present invention can come in a variety of different sizes as does a conventional sock. As described above in connection with sock 1, although the lower leg portion 4 of sock 30 shown in FIGS. 8 and 9 is relatively short, as with conventional socks, the lower leg portion 4 of the sock may be made longer without departing from the spirit of the present invention.

The easy-on sock 30 of FIGS. 8–10 is similar to sock 1 of FIGS. 5–7 in many other respects. As with sock 1, sock 30 of the present embodiment includes a split 13 extending from toe pocket 2 through upper portion 5 and lower leg portion 4. Split 13 preferably bisects upper portion 5 and lower leg portion 4 of the sock, but could equally well be off-center from the line of symmetry of the sock. Again, the split could be slanted or curved across the top portion of the sock in order to accommodate different foot injuries.

On either side of split 13 are opposing edges 7 and 8 which extend the length of the split 13. As described above, split 13 may be made by simply taking a conventional sock and cutting it along the center line of the lower leg portion and the upper portion of the sock until the cut is adjacent to toe pocket 2 of the sock. A reinforcing stitch 17 can then be made at the point where the split terminates in the toe section, 32 in order to prevent the split from extending by unwanted tearing into the toe portion 2. Thus, the cut that produces, split 13 renders the sock 30 completely open except for the relatively small toe pocket defined at the end of the sock.

As with sock 1, an extension flap 6 is attached to the sock 30. Extension flap 6 is preferably in the form of an elongated strip having a length substantially equal to the length of the split 13 and a width on the order of two inches or more. Extension flap 6 includes side edge 14 and side edge 15. In making the easy-on sock 30, side edge 14 is connected along edge 7 of split 13, by sewing, integrally forming or any other acceptable means described herein and/or which are well known in the art.

Figure 12A:
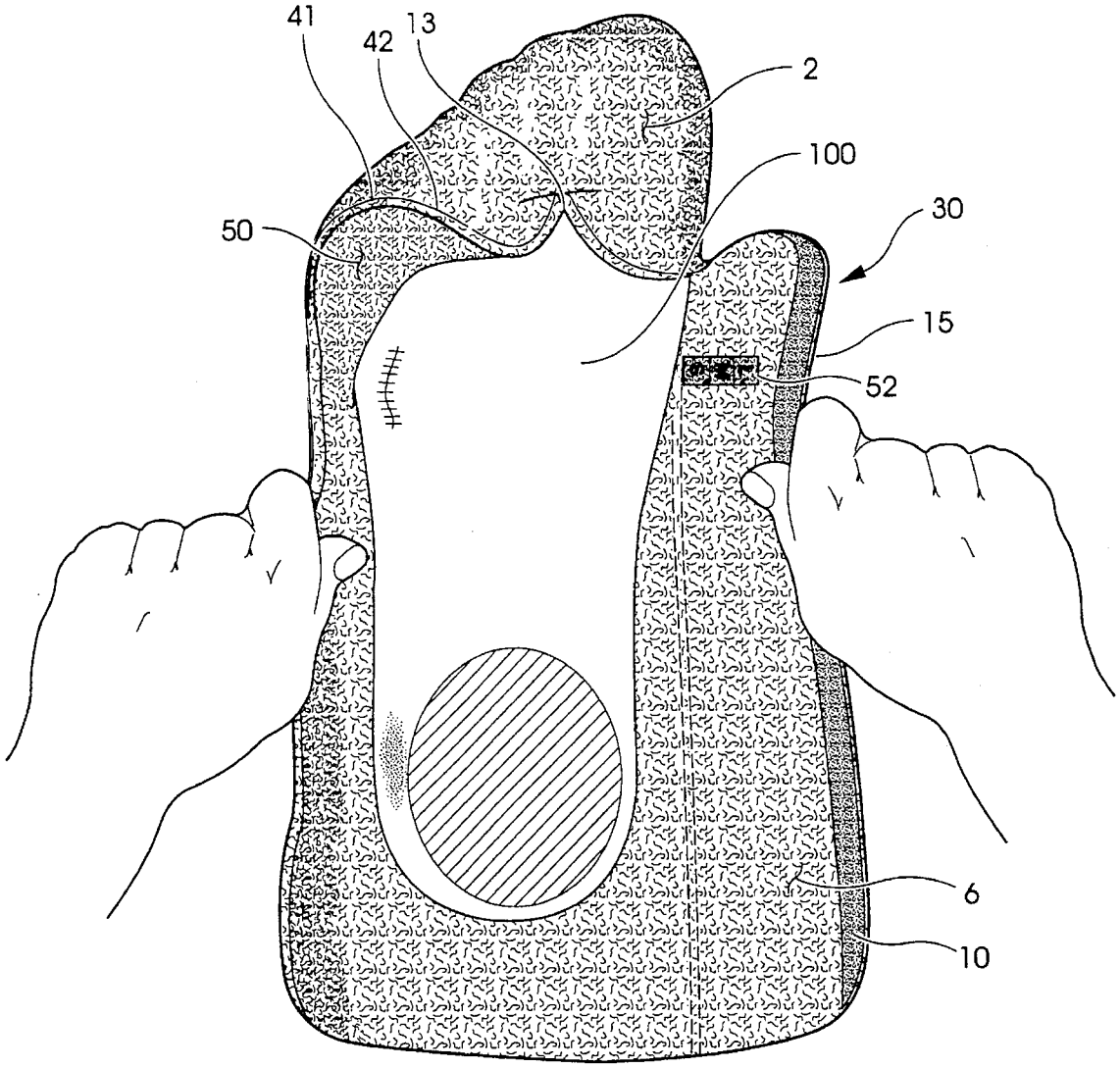
FIGS. 12A and 12B are top views of the injured foot of FIG. 5 after an easy-on sock according to the embodiment of FIG. 9 of the present invention has been partially placed on the person's foot.
Figure 12B:
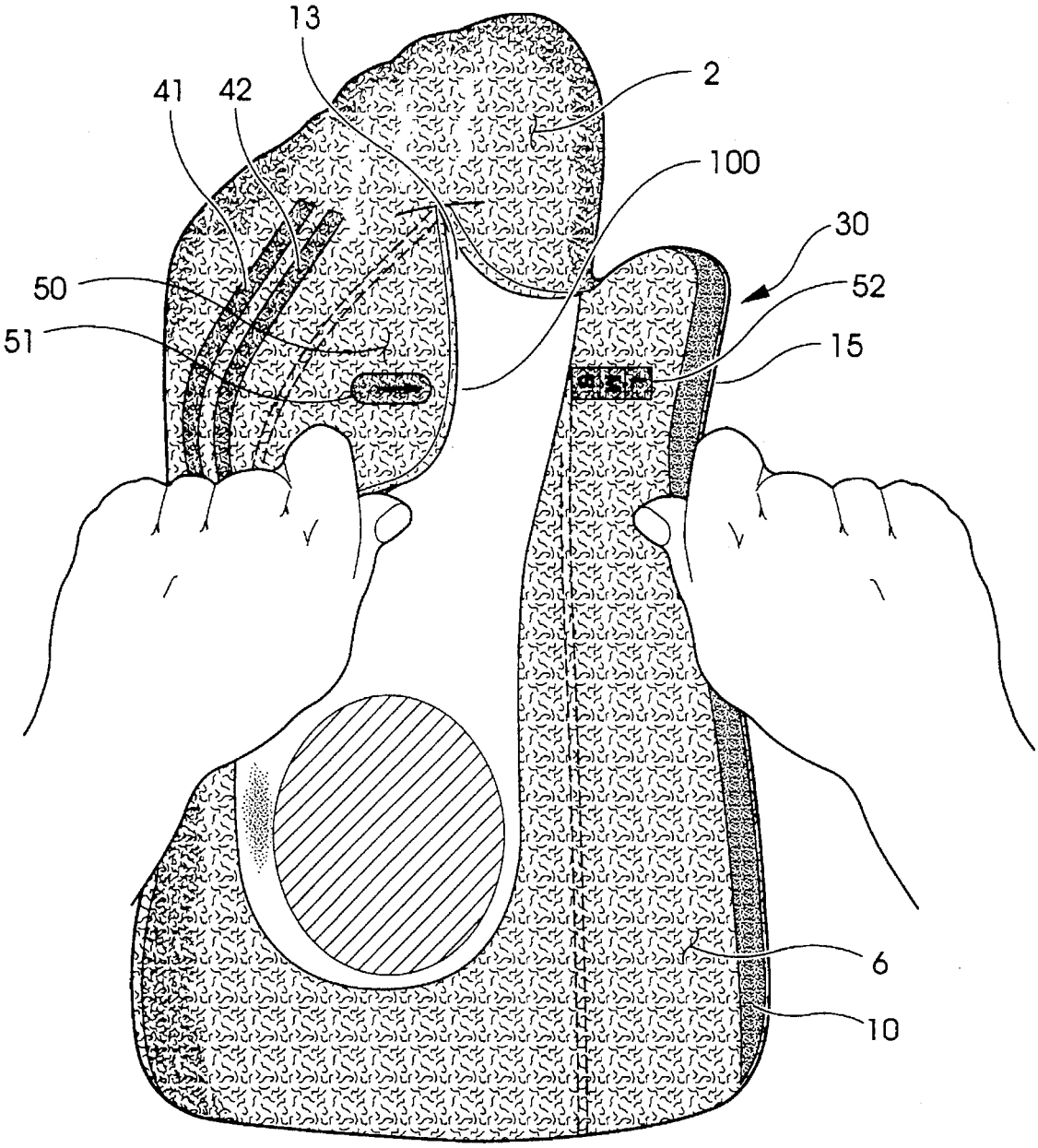

Sock 30 additionally includes an insert flap 50, which aids the user in putting the sock 30 on the foot by providing a gripping surface as shown in FIGS. 12A and 12B. Insert flap 50 is preferably made from the same material as the remaining portion of the sock, but could equally well be made from a different fabric.

As shown in FIGS. 8–10, insert flap 50 is preferably made having a bell-shaped curvature wherein the insert flap 50 is widest at its central most point and then tapers away from the center at each side. One reason for the tapering sides is to prevent the fabric from bunching up under the extension flap when that flap is closed over the insert flap. In one particular embodiment of the present inventions the insert flap is four and one-half inches long and is two inches wide at its widest point. This is not meant to be limiting, as the insert flap 50 may be made using other designs (i.e. semi-circular, triangular, trapezoidal, etc.) and/or dimensions. For example, the insert flap 50 may be sized so that a substantial portion of the instep may be covered. The insert flap 50 does not extend the entire length of split 13 but preferably only covers a portion of the instep.

The insert flap 50 includes side edge 38 and side edge 39. In making easy-on sock 30, side edge 38 is connected along edge 8 of split 13, by sewing, integrally forming or any other acceptable means.

Like the remainder of the sock 30, the extension flap 6 and insert flap 50 both have an inner surface 19 and an outer surface 18. Attached to the inner surface 19 of the extension flap 6, adjacent side edge 15, is a strip of hook and loop closure material 10, which is preferably on the order of one-half to one inch wide. Hook and loop closure strips 41, 42, 43 and 44 are attached on the outer surface of the sock 30 along edge 8 of split 13, and may be as described in connection with the hook and loop closures of the above embodiments shown in FIGS. 1–3 and FIG. 4. In one preferred embodiment, strips 41 and 42 run parallel to each other and are separated by about one-quarter of an inch. Likewise, in that preferred embodiment strips 43 and 44 are parallel and are separated by about one-quarter of an inch. In another preferred embodiment, strips 41 and 42 are not quite parallel, but rather, slope away from each other near the toe pocket 2, so that there is a greater distance between strips 41 and 42 at the toe portion 2 than at the heel portion 3.

For purposes of the present invention it is irrelevant whether the hook strip is attached to the sock or the extension flap. What is important is that strip 10 be either a hook or a loop strip and that strips 41–44 be the other of the hook or loop so that strip 10 can be releasably secured to strips 41–44. Strips 10, 41, 42, 43 and 44 are preferably sewn to the underlying material but could equally well be attached in some other fashion which is well known in the art, such as by snaps or adhesives.

Further, sock 30 includes a connector 51 attached to the outside surface of the insert flap 50. In the preferred embodiment, the connector 51 is oriented on the insert flap 50 relatively perpendicular to the strips 41 and 42. In one particular preferred embodiment, the connector 51 is two inches in length and three-quarters of an inch wide. Additionally, in the preferred embodiment a tip indicator (53 of FIG. 14A) is located on the connector 51 at the portion of the connector 51 which is adjacent the edge 39. Although it is preferred that the connector 51 be oval, other shapes may be used.

Sock 30 additionally includes a sizing strip 52, which is attached to the inner surface 19 of the extension flap 6, opposite the connector 51. Both connector 51 and sizing strip 52 are made of hook and loop closure materials. It is desired that in the preferred embodiment, the sizing strip will comprise the soft, loop-type closure strip, so as to reduce the chance of irritation in case the sizing strip should accidentally come in contact with the foot. However, the hook type closure strip may be used as the sizing strip, if desired.

Figure 11:
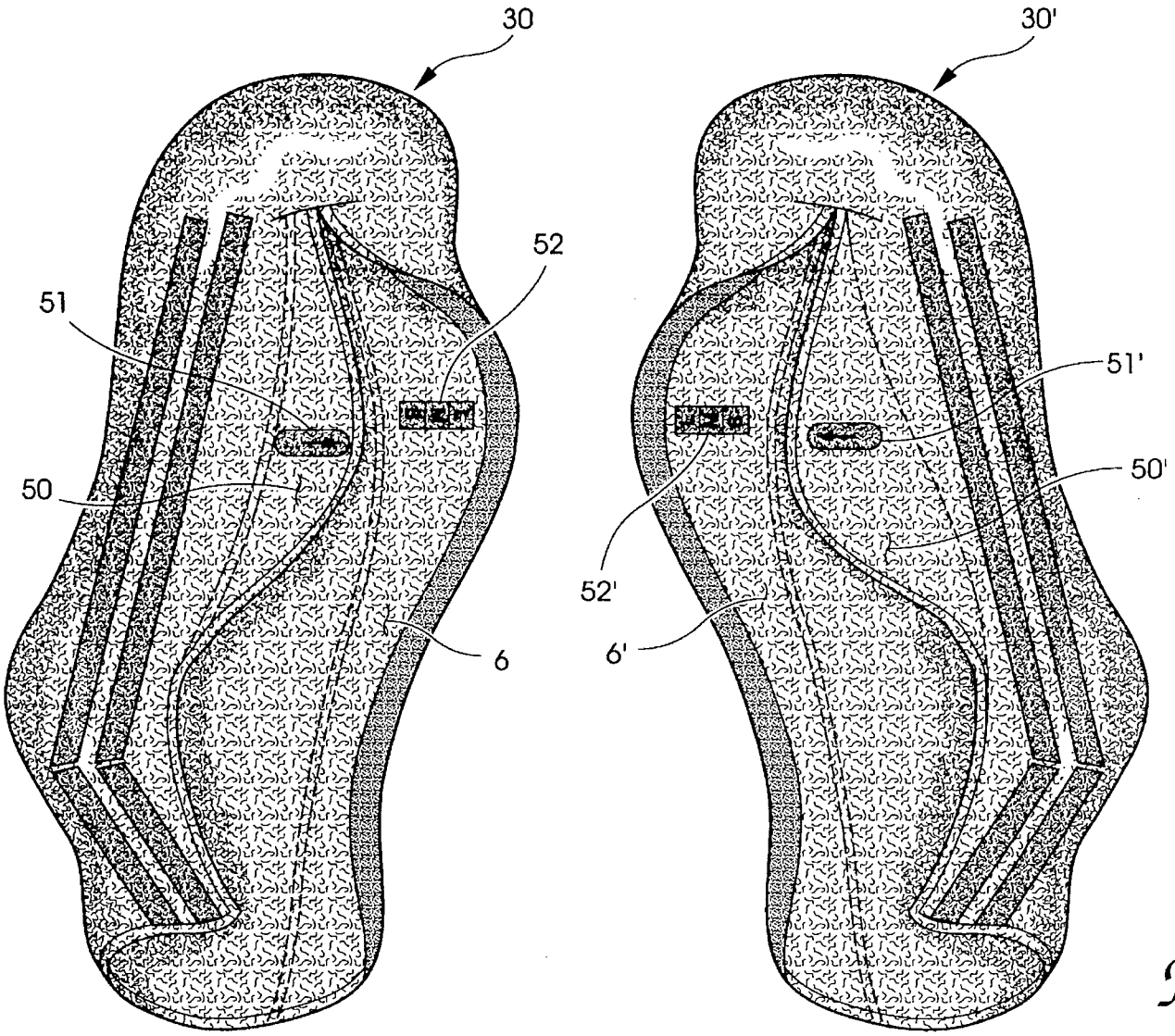
FIG. 11 is a top view of a pair of socks according to the embodiment of FIG. 9 of the present invention.
Figure 13:
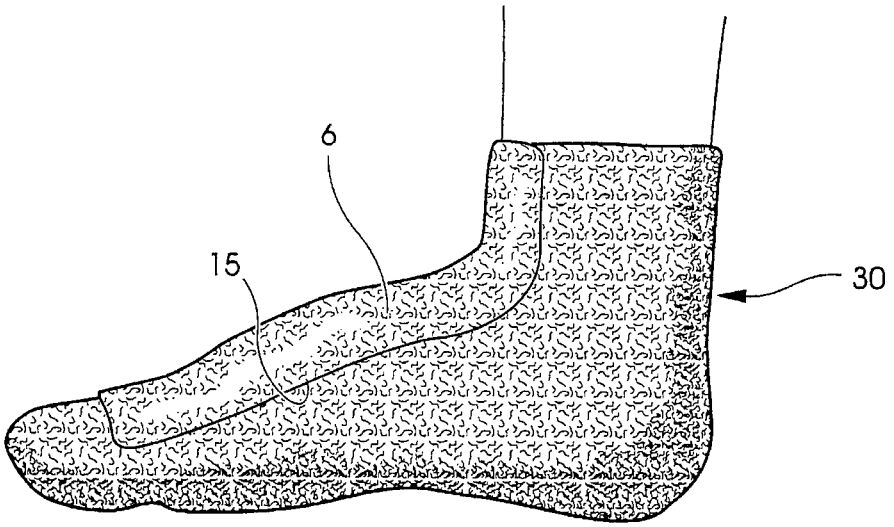
FIG. 13 is a side view of the injured foot of FIGS. 5 and 12A and 12B after the easy-on sock has covered the person's foot.

The location of the sizing strip 52 on the extension flap 6 is chosen such that when the sock 30 is closed (as shown in FIG. 13), the connector 51 will mate with at least a portion of the sizing strip 52, and hook and loop closure strip 10 will mate with the appropriate strips 41, 42, 43 and/or 44. Thus the connector 51 and the sizing strip 52 are aligned as shown in FIGS. 9–11 so as to mate across the instep of the foot.

Figure 14A:
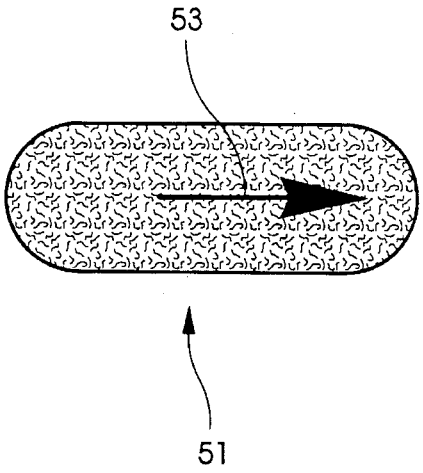
FIG. 14A is a view of one type of connector which may be used in connection with the embodiment of FIG. 9.
Figure 14B:
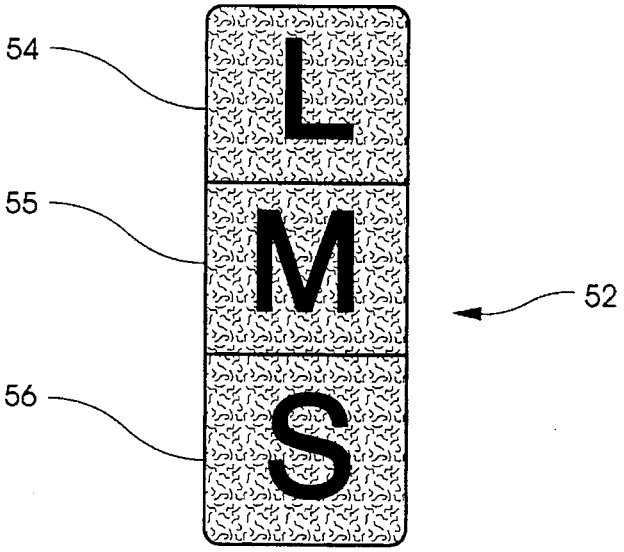
FIG. 14B is a view of one type of sizing strip which may be used in connection with the embodiment of FIG. 9.

FIGS. 14A and 14B show the connector 51 and the sizing strip 52 in greater detail. As noted above, the connector 51 of the present embodiment is oval in shape and includes a tip indicator 53. The tip indicator 53, which may be imprinted on the connector 51 with ink or other suitable imprinting means, aids in aligning the connector 51 with a desired position on the sizing strip 52. As noted above, tip indicator 53 is preferably located adjacent the edge 39 of the insert flap 50.

As shown in FIG. 14B, the sizing strip 52 is preferably rectangular in shape and is attached to the extension flap such that the length of the sizing strip is substantially perpendicular to the length of the extension flap. In one particular embodiment the sizing strip is three inches long and three-quarters of an inch wide. It is intended that the connector 51 be able to mate with the sizing strip 52 anywhere along the length of the sizing strip 52. Additionally, the sizing strip of the preferred embodiment is FIG. 14B is marked as including three regions thereon, the "S" region 56, the "M" region 55 and the "L" region 54. The three regions are marked so as to provide the user with an alignment tool to suggest where to position the tip indicator 53 for various foot types and/or injuries. For example, for large, heavily swollen or heavily bandaged feet the tip of the connector 51 should be placed in the "L" region. Likewise, for medium sized or moderately swollen or bandaged feet the "M" region may be most appropriate. Similarly, for smaller feet the sock 30 would most likely be best fitted by placing the tip indicator in the "S" region. The "L" region 54 is located furthest from the edge 14 and nearest to (although not adjacent) the edge 15 of the extension strip 6. Correspondingly, the "S" region 56 is the region nearest the side edge 14. As such, the sock 30 may easily be fitted to any thickness or width of foot simply by aligning the tip indicator 53 of the connector 51 to the appropriate region of the sizing strip 52. Additionally, the fit of the sock 30 may be easily readjusted as the size of the foot changes due to changes in the amount of swelling or the amount of bandages used.

Although, the use of the symbols "L", "M" and "S" and an arrow are used in the preferred embodiment of sock 30, this is not meant to be limiting. Other symbols may be used instead of those recommended herein. Likewise, the connector 51 and sizing strip 52 may be left blank, thus omitting any type of alignment tools.

In FIG. 11 there is shown a pair of socks 30 and 30' of the type described above in connection with FIGS. 8–10. Note that the socks 30 and 30' are intended for use on the left and right foot, respectively. As such, the extension flap of each sock closes toward the outside of the foot as described in connection with FIG. 4 above.

FIGS. 5, 12A, 12B and 13, illustrate how the easy-on sock of the present invention can be put on a person's injured foot 100 in a way that avoids the painful squeezing, pulling and rubbing of conventional socks. As in the above case described in connection with FIGS. 5–7, foot 100 is healing from a stitched cut 101 and a bruise 102, both of which would cause pain if a conventional sock was squeezed and slid over the foot. The first step in putting on the easy-on sock 30 is accomplished by simply inserting the person's toes 103 into the toe pocket portion 32 with the sock split wide open as shown in FIG. 12A. Preferably, this is done without the remainder of the person's foot, particularly the injured portions 101 and 102, having to come into contact with the remainder of the sock. Once the toes are covered, the person moves the sole portion of the sock into contact with the bottom of the person's foot by gripping side edge 39 of the insert flap with one hand and side edge 15 of extension flap 6 with the other hand.

Then, as shown in FIG. 12B, the insert flap is folded over the instep of the foot 100, where it is then tucked slightly under the extension flap 6. The tip indicator 53 of the connector 51 is made to contact the desired region of the sizing strip 52, thus joining or mating the connector 51 to the sizing strip 52. Mating the tip of the connector 51 to a particular region of the sizing strip 52 in this manner allows the the sock to be more closely fitted to each individuals foot across the instep. Further, mating the connector 51 and sizing strip 52 has the added advantage of providing initial closure of the sock to aid in alignment of the hook and loop strips 10 and 41, 42, 43 and/or 44 without undue effort.

After the connector 51 and sizing strip 52 have been joined, the sock 30 may then be fully closed simply by wrapping extension flap 6 over the instep of the person's foot and then contacting strip 10 against the strips 41, 42, 43 and/or 44, thus securing the sock closed as shown in FIG. 13. Thus, as shown in FIG. 13, with both the connector/sizer strip coupling and the coupling of closure strip 10 to one or more of strips 41, 42, 43 and/or 44, sock 30 looks and wears like a conventional sock. Additionally, as with the sock 1 of the above described embodiments, apart from possibly the person's toes, easy-on sock 30 can cover a foot without the squeezing and/or rubbing that inherently accompanies conventional socks.

The fit of sock 30 of the present embodiment may be easily adjusted by moving the tip indicator 53 of the connector 51 to a different place along the sizing strip 52 and/or simply by placing the extension flap over any part of the closure strips 41 and 42. In this way the sock 30 may be adjusted to accommodate swelling and tenderness by eliminating tightness and pain in the injured area of the foot.

Thus it is clear that the easy-on sock of the present invention can be placed on a person's foot without the fabric of the sock rubbing or sliding over an injury, and the adjustability of the sock, and versatility of the hook and loop type fasteners, allows it to be placed on the foot without any unnecessary squeezing which could otherwise cause pain to an injured foot. The present invention also enables those persons with limited flexibility, due to such afflictions as arthritis, to more easily put socks on their feet.

Referring now to FIGS. 15A, 15B and 16 there is shown an easy-on sock 200 of a further embodiment. The easy-on sock 200 of the present embodiment is virtually identical in all respects to easy-on sock 1 of FIGS. 1–3, with the exception that sock 200 is depicted as having elastic bands 220 throughout the lower leg portion 204, as do conventional socks. These elastic bands 220 allow the lower leg portion 204 of the sock 200 to better fit the user. Additionally, FIG. 15B is an enlarged portion of the inner surface 19 of the sock 200 depicting a looped pile or terry cloth type material which is present throughout the sock 200, from the toe portion 202 to the point at which the elastic bands 220 begin at the base of the lower leg portion 204. This looped pile material, present in some types of conventional socks (i.e. tube socks), provides greater comfort and padding for the injured foot. Additionally, although the use of elastic and looped pile has been shown in FIGS. 15–16 in connection with the sock of the type described in connection with FIGS. 1–3, these features may be incorporated in any of the embodiments of the present invention described herein.

While the invention has been illustrated and described in detail in the drawings and foregoing description, the same is to be considered as illustrative and not restrictive in character. For instance, for purposes of clarity, the present invention has been described as a modification of a conventional sock. In other words, the extension flap and/or the insert flap described herein could be integrally formed along one edge of the split instead of attached thereto as described above. It being understood that only the preferred embodiment has been shown and described and that all changes and modifications that come within the spirit of the invention are desired to be protected.

What is claimed is:

1. A method of atraumatically placing a sock on a foot, comprising the steps of:

providing a sock made entirely from a soft and flexible fabric with a toe pocket, said soft and flexible fabric including a loop pile material in contact with the foot, a sole portion, a heel portion, a lower leg portion and an upper portion, the sock having a split extending from the toe pocket through the lower leg portion, an extension flap connected to the sock to close the split, and closure means attached to the extension flap and along the split, said closure means including at least one mating portion of hook and loop closure material;

laying said sock open except for said toe pockets, including laying said lower leg portion substantially flat such that it lays substantially within the same plane as at least a portion of said sole portion when said sock is laid open;

inserting the toes of the foot into the toe pocket with the split open;

contacting the sole of said foot with said sole portion with the split open;

wrapping said sock around the foot by covering the foot with at least said extension flap and said upper portion; and securing the closure means to close the split and cover the foot.

2. The method of claim 1, wherein said providing step includes providing a sock wherein said lower leg portion includes elastic, wherein said elastic is more flexible than said flexible fabric and wherein said elastic causes said lower leg portion to conform to a lower leg of a user.

3. The method of claim 1 wherein the step of inserting the toes of the foot into the toe pocket is accomplished without the fabric of the sock contacting the remainder of the person's foot.

4. The method of claim 3 wherein the step of wrapping the sock around the foot is accomplished without the fabric of the sock rubbing against the person's foot.

5. The method of atraumatically placing a sock on a foot of claim 1 wherein the providing step includes providing a sock including an insert flap having a first side edge and a second side edge, said first side edge being connected to said sock along said split and wherein said extension flap overlays said insert flap to close said split, said insert flap additionally including a hook type connector attached thereto.

6. A sock for atraumatically covering a tender foot subject to pain when squeezed or rubbed, comprising a toe pocket, a sole portion, a heel portion, a lower leg portion and an upper portion extending between said toe portion and said lower leg portion;

said toe pocket being sized to receive a person's toes without contacting the remaining portion of the person's foot;

said sock having a split extending from said toe pocket through said lower leg portion, said split defining first and second opposing edges that terminate at said toe pocket;

an extension flap having a first side edge and a second side edge, said first side edge being connected to said sock along said first opposing edge of said split; and adjustable closure means, attached to said extension flap along said second side edge and attached to said sock along said second opposing edge, for releasably securing said second side edge of said extension flap to said second opposing edge of said sock to cover and close said split, and being adjustable to permit a wearer of said sock to limit the amount of pressure exerted by said sock on the foot of the wearer, said closure means including at least one mating portion of hook and one loop closure material; and wherein said sock and said extension flap are made entirely from a soft and flexible fabric, such that said lower leg portion lays substantially within said plane as at least a portion of said sole portion when said sock is laid open.

7. The sock of claim 6 wherein said closure means is a plurality of hook and loop closure strips.

8. The sock of claim 7 wherein said extension flap is greater than two inches wide.

9. The sock of claim 8 wherein said lower leg portion includes an elastic material, said elastic material being more flexible than said flexible fabric.

10. The sock of claim 8 wherein said first side edge of said extension flap is sewn to said first opposing edge of said sock along said split.

11. The sock of claim 10 wherein said hook and loop closure strips are greater than ⅓ inch wide.

12. The sock of claim 10 wherein said hook and loop closure strips extend substantially continuously along said second side edge of said extension flap and said second opposing edge of said split.

13. The sock of claim 12 wherein a first hook and loop closure strip extends substantially continuously along said second side edge of said extension flap; and a plurality of opposing hook and loop closure strips are arranged in spaced apart relationship along said second opposing edge such that said second side edge of said extension flap can be adjustably secured to said second opposing edge so said sock can accommodate a range of foot sizes.

14. The sock of claim 6 additionally comprising an insert flap having a first side edge and a second side edge, said first side edge being connected to said sock along said second opposing edge of said split and wherein said extension flap overlays said insert flap to close said split.

15. The sock of claim 14 wherein said lower leg portion includes an elastic material, wherein said elastic material is more flexible than said flexible fabric, said elastic material for permitting said lower leg portion to stretch.

16. The sock of claim 14 wherein said insert flap includes a hook type connector.

17. A sock for atraumatically covering a tender foot subject to pain when squeezed or rubbed, comprising a toe pocket, a sole portion, a heel portion, a lower leg portion and an upper portion extending between said toe portion and said lower leg portion;

said toe pocket being sized to receive a person's toes without contacting the remaining portion of the person's foot;

said sock having a split extending from said toe pocket through said lower leg portion, said split defining first and second opposing edges that terminate at said toe pocket;

an extension flap having a first side edge and a second side edge, said first side edge being connected to said sock along said first opposing edge of said split; and an insert flap having a first side edge and a second side edge, said first side edge being connected to said sock along said second opposing edge of said split and wherein said extension flap overlays said insert flap to close said split;

wherein said insert flap includes a hook and loop type connector and wherein said extension flap includes a hook and loop type sizing strip, said connector being detachably mated with said sizing strip to close said split over the instep of the foot;

adjustable closure means, attached to said extension flap along said second side edge and attached to said sock along said second opposing edge, for releasably securing said second side edge of said extension flap to said second opposing edge of said sock to cover and close said split, and being adjustable to permit a wearer of said sock to limit the amount of pressure exerted by said sock on the foot of the wearer, said closure means including at least one mating portion of hook and one loop closure material; and wherein said sock and said extension flap are made entirely from a soft and flexible fabric.

18. The sock of claim 17 wherein said sizing strip is divided into at least first and second regions.

19. The sock of claim 18 wherein the pressure exerted on said foot is greater if said connector is joined to said sizing strip in said first region.

20. A method of atraumatically placing a sock on a foot, comprising the steps of:

providing a step made entirely from a soft and flexible fabric with a toe pocket, a sole portion, a heel portion, a lower leg portion and an upper portion, the sock having a split extending from the toe pocket through the lower leg portion, said split including a first and a second edge, an extension flap connected to the sock at said first edge to close the split, an insert flap connected to said sock at said second edge, and closure means attached to the extension flap and along the split at said second edge, said closure means including at least one mating portion of hook and loop closure material;

laying said sock open except for said toe pocket, including laying said lower leg portion substantially flat such that it lays substantially within the same plane as at least a portion of said sole portion when said sock is laid open;

inserting the toes of the foot into the toe pocket with the split open;

contacting the sole of said foot with said sole portion with the split open;

wrapping said sock around the foot by covering a portion of the foot with said insert flap;

wrapping said extension flap and said upper portion over said insert flap; and securing the closure means to close the split and cover the foot.

21. The method of atraumatically placing a sock on a foot of claim 20, wherein said providing step includes providing said sock including said insert flap, wherein said insert flap includes a hook and loop type connector, and wherein said extension flap includes a hook and loop type sizing strip.

22. A method of atraumatically placing a sock on a foot, comprising the steps of:

providing a sock made entirely from a soft and flexible fabric with a toe pocket, a sole portion, a heel portion, a lower leg portion and an upper portion, the sock having a split extending from the toe pocket through the lower leg portion, said split including a first and a second edge, an extension flap connected to the socket at said first edge to close the split, an insert flap connected to said sock at said second edge, and closure means attached to the extension flap and along the split at said second edge, said closure means including at least one mating portion of hook and loop closure material, wherein said providing step includes providing said sock including said insert flap, wherein said insert flap includes a hook and loop type connector, and wherein said extension flap includes a hook and loop type sizing strip;

laying said socket open except for said toe pocket;

inserting the toes of the foot into the toe pocket with the split open;

contacting the sole of said foot with said sole portion with the split open;

wrapping said sock around the foot by covering a portion of the foot with said insert flap;

wrapping said extension flap and said upper portion over sad insert flap;

mating said connector to said sizing strip to close said slit over the instep of the foot, prior to securing the closure means; and securing the closure means to close the split and cover the foot.

* * * * *